United States Patent [19]

Fitz

[11] Patent Number: 4,487,207

[45] Date of Patent: Dec. 11, 1984

[54] LUNG EXERCISING DEVICE AND METHOD

[76] Inventor: Edward Fitz, 27 Llanfair Rd., Ardmore, Pa. 19003

[21] Appl. No.: 311,667

[22] Filed: Oct. 15, 1981

[51] Int. Cl.[3] ..... A61B 5/08

[52] U.S. Cl. ..... 128/728; 272/99

[58] Field of Search ..... 128/725, 727, 728; 272/99

[56] References Cited

U.S. PATENT DOCUMENTS

| | | | |
|---|---|---|---|
| 3,669,097 | 6/1972 | Fitz | 128/728 |
| 4,096,855 | 6/1978 | Fleury, Jr. | 128/727 |
| 4,143,872 | 3/1979 | Hausted et al. | 272/99 |
| 4,241,739 | 12/1980 | Elson | 128/725 |
| 4,299,236 | 11/1981 | Poirier | 128/728 |
| 4,323,078 | 4/1982 | Heimlich | 128/728 |

*Primary Examiner*—Lee S. Cohen

*Attorney, Agent, or Firm*—Stuart E. Beck

[57] ABSTRACT

A device and method for increasing inhalation strength and capacity of the lungs.

The device includes an air inlet and air outlet which are interconnected by a conduit. A valve in the conduit is opened by the pressure differential created when the user inhales through a mouthpiece. The valve is biased to a normally closed position. The biasing force is adjustable so that the force required to open the valve during inhalation can be varied to increase the strength of the users' lungs. A timer is provided for monitoring the length of time of successive inhalations.

The method includes the steps of inhaling through a mouthpiece and flexible conduit, creating a vacuum in said conduit of sufficient force to open a variable resistance valve, and breathing in atmospheric air to fill the lungs. The amount of air inhaled is monitored.

25 Claims, 6 Drawing Figures

FIG. 1
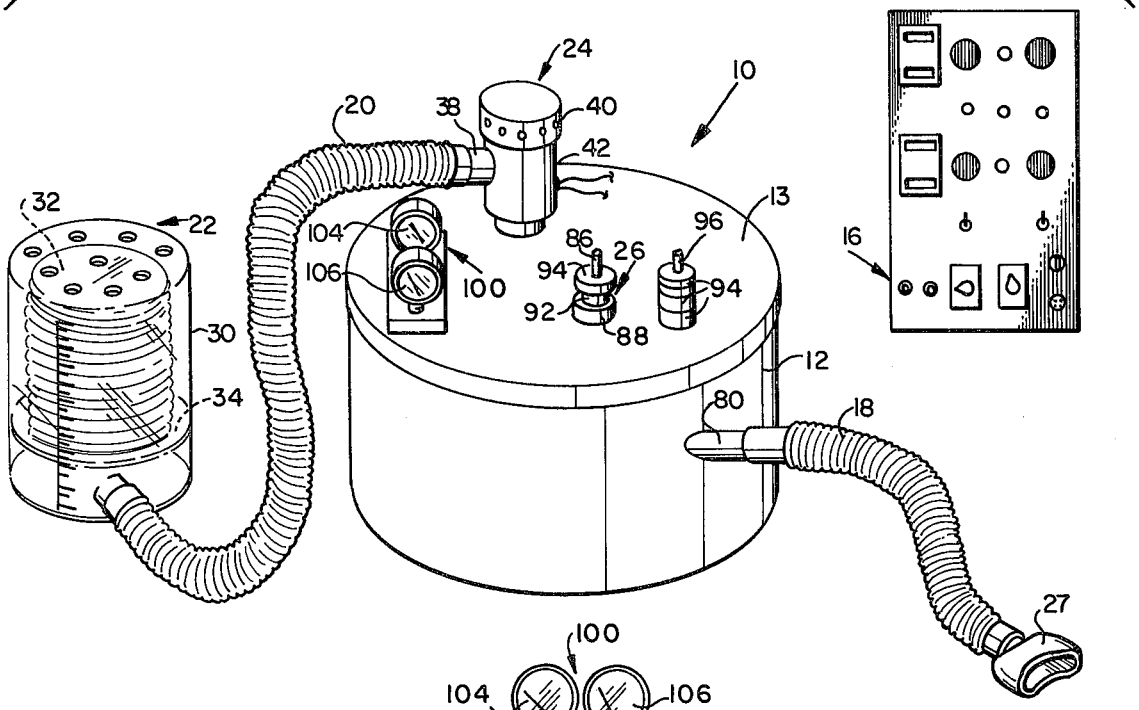
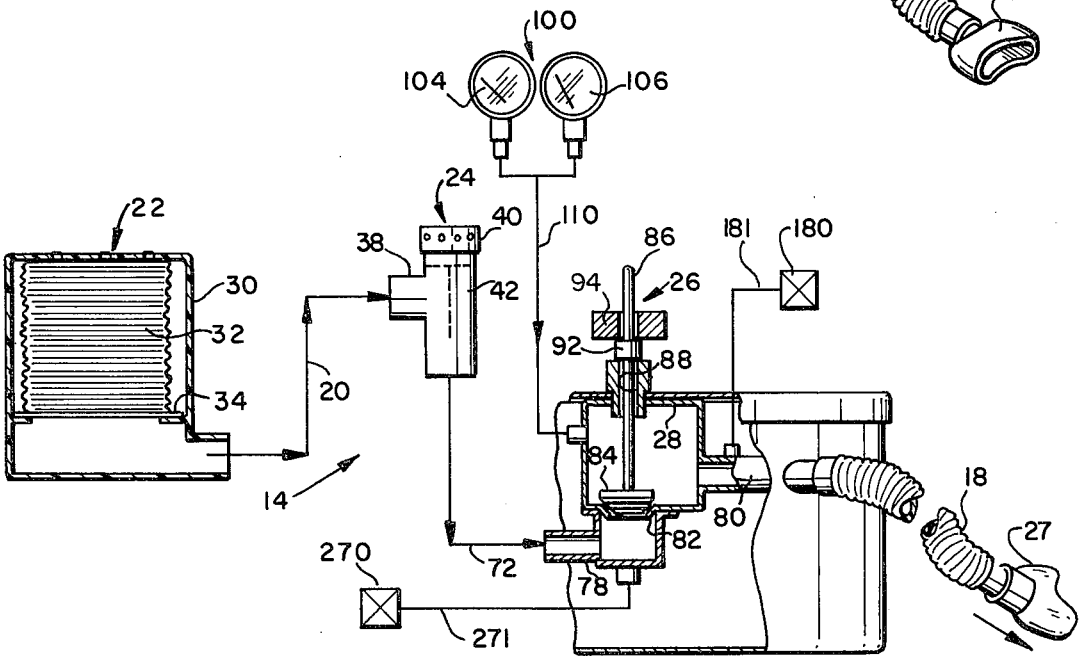
FIG. 2

140
142
144
146
158
162
164
166
168
170
172
150
152
154
186
188
185
184
178
180
182
192
194
202
336A
206
210
218
190
314A
223
224
208
216
214
196
226
198
197
200
244
212
230
200A
236
239
238
240
252
256
234
246
231
254
272
274
250
270
278
286
280
282
284
283
302
258
262
268
300
250A
264
266
265
194A
294
314B
310
348A
310A
318
308
314
312
148
336
324
310B
194B
336B
344
346
348
350
314C
354
60
360
314D
362
356
358
366
364
368
378
357
118
370
380
116
372
382
382A
384
382B
386

LUNG EXERCISING DEVICE AND METHOD

BACKGROUND OF THE INVENTION

This invention relates to a device and method for increasing the strength and capacity of the lungs. More particularly it relates to a device and method for exercising the lungs and increasing their capacity for inhalation.

Devices for developing the lungs have been described for quite some time in the past. Examination of these devices, most of which work by controlling or monitoring the act of exhalation, show they are lacking in several aspects. Thus, they may only be capable of increasing the strength and volume of exhalation without providing a capability for measuring the time during which air is exhaled. The quantity of air exhaled is considered to be an indicator of total lung capability. However, an apparatus adapted to increase lung strength and volume for exhalation does not necessarily result in increased lung volume and strength for inhalation. Another disadvantage of such devices is the lack of human engineering in that they provide no means for creating an incentive or gauge so that the user can measure his progress.

It was in response to these deficiencies and others that I developed the improved exhalation system described in my U.S. Pat. No. 3,669,097, dated June 13, 1962. Most recently I found that a superior approach toward meeting the dual objectives of increasing lung strength and capacity can be made by controlling and monitoring the act of inhalation rather than exhalation.

SUMMARY OF THE INVENTION

The device and method of the present invention are adapted to increase both the strength and capacity of the lungs for inhalation. Inhalation is resisted by a controllable variable resistance valve which only opens when the level of vacuum created by the expansion of the lungs for inhalation exceeds a preset value so that the lungs must work and thereby exercise to perform their function. Operation of the device is enhanced by incorporating a set of presettable totalizing timers which allow the establishment of specific goals for inhalation and breathing time. These items along with a set of horns and lights provide both visual and audible feedback that indicate the achievement of specific goals, thus inspiring continued effort by the user.

These and other advantages are secured in the present invention by providing a device and method which includes an adjustable variable resistance valve for restricting the opening in the conduit which is disposed between an inlet chamber and an outlet mouthpiece. By adjusting the resistive loading of the valve, the pressure differential necessary to cause it to open during inhalation to enable air to pass into the mouthpiece can be increased or decreased, thus providing a positive means to exercise the lungs and their associated muscles.

A variable volume chamber and vent valve may be attached to the device. Inhalation will cause the variable volume chamber to expand, and opening the vent valve will cause it to return to its normal position.

After inhalation is completed the vent valve opens to ready the device for the next inhalation cycle. Means are provided for enabling the vent valve to open automatically for a programmed breathing cycle, or manually when it is expected that the duration of the inhalation cycle might change.

Thus, it is the primary object of the present invention to provide an inhalation monitoring system for increasing the strength and capacity of the lungs.

It is the further object of the present invention to provide means for setting specific lung strength and capacity goals and to return feedback signals indicative of the progress toward the reaching of such goals by the user.

These and other objects of the present invention will be more fully understood from the following detailed description taken in conjunction with the attached drawings. However, it should be understood that while the drawings show a form which is presently preferred, the invention is not limited to precise arrangements and instrumentalities shown but rather by the scope of the claims appended thereto.

BRIEF DESCRIPTION OF THE DRAWINGS

FIG. 1 is an overall perspective view of the lung exercise device constructed in accordance with the present invention.

FIG. 2 is a schematic air flow diagram of the device in FIG. 1.

DETAILED DESCRIPTION OF THE PREFERRED EMBODIMENT

Figure 3:
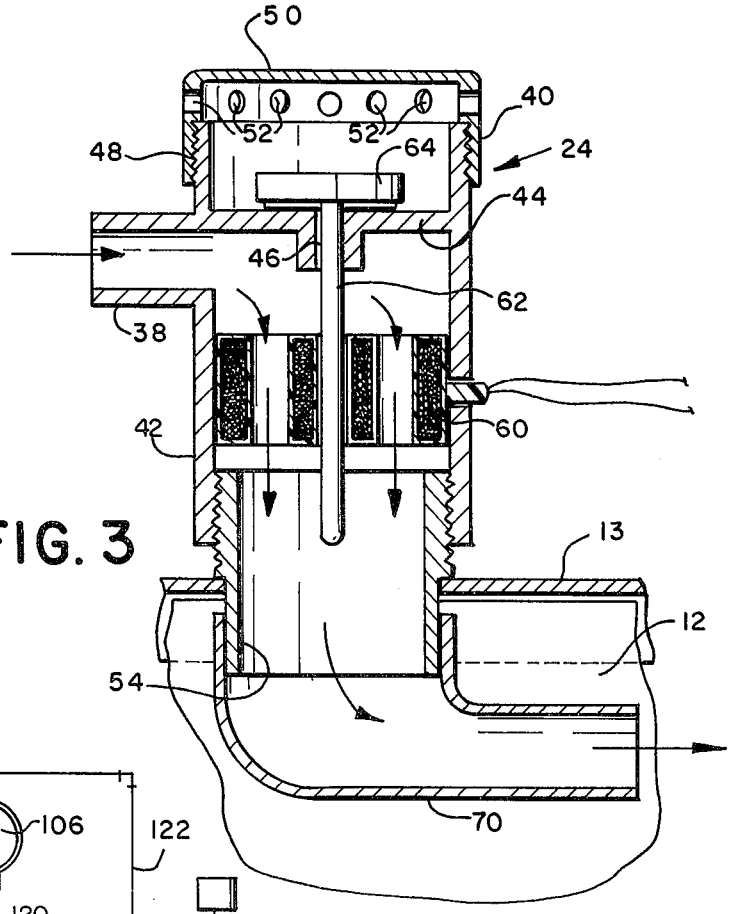
FIG. 3 is a sectional view of a portion of the device shown in FIG. 1.

Referring now to the drawings where like numbers illustrate like elements throughout the several views there is shown in FIG. 1 a lung strengthening device 10. The device comprises a housing 12 having a cover plate 13, an elongated air flow conduit 14 and a control panel 16. The elongated conduit 14 (FIG. 2) includes an outlet conduit 18, an inlet conduit 20, a bellows housing 22, vent valve housing 24 and a variable resistance valve 26. A mouthpiece 27 is connected to the distal end of conduit 18.

As best seen in FIGS. 1 and 2, the bellows 32 comprises an outer rigid housing 22 which may be transparent and have a scale along its length. It is connected to ambient air by means of suitable orifices (not shown). Contained within the housing 22 is a normally collapsed bellows 32 which is secured at its bottom to an annular plate 34. The interior of the bellows is connected by way of inlet conduit 20 to the inlet duct 38 of housing 24.

The bellows is used to measure the volume of atmospheric air inhaled if desired. A suitable bellows may be a volumetric spirometer such as the Salter Labs EMFLEX 7600 which is built by Empire Medical, Inc. of Decatur, Ga. Such a bellows expands when air is withdrawn; a venting valve being opened after inhalation to empty it for the next inhalation cycle.

As best seen in FIG. 3, the housing 24 comprises a cylindrical housing 42 having an inwardly directed flange 44 with a central opening 46 therein. The inlet duct 38 is coupled to the interior of the solenoid housing 40 at a location below flange 44. The upper walls of the cylindrical housing 42 are threaded at 48 to threadingly receive a cap 50. The cap 50 is provided with a plurality of apertures 52 on its annular side wall and its top.

The lower portion of the housing is threaded on its outer wall to be received in a threaded opening in cover plate 13. A portion of the housing extends below plate 13 to form a flange 54.

Arranged within the housing 42 is a solenoid coil 60 with an elongated shaft 62 extending therethrough. At the top of shaft 62 is a valve head 64. Normally, as when the solenoid coil 60 is not energized, the valve head 64 lies against the upper surface of flange 44 so that the air flow is by way of inlet duct 38, housing 42 and then down through the cover plate 13 into elbow 70.

Elbow 70 is connected by a suitable conduit 72 (FIG. 2) to the inlet portion of the housing 28 of variable resistance valve 26. Valve housing 28 is contained within the aforementioned housing 14. It comprises a lower inlet portion 78 and an upper outlet portion 80. The inlet and outlet portions of the valve are connected by a valve seat 82 which receives a valve head 84 which has extending upwardly therefrom an elongated stem 86. As seen in FIG. 1, the stem 86 extends upwardly through a housing 88 on cover plate 13.

The diameter of the stem is somewhat less than the diameter of the opening in the housing 88 through which it passes to provide for a slight leakage of air into the valve housing even when the valve head is not raised from the valve seat so that suffocation cannot occur.

The valve stem includes a flange 92 which is fixed to it. Weights 94 which can be conveniently stored on cover 13 by being mounted on shaft 96 can be placed on stem 86 so that they lie on flange 92. By varying the number of weights placed on stem 86 the amount of force necessary to raise valve head 84 off seat 86 can be varied.

Figure 4:
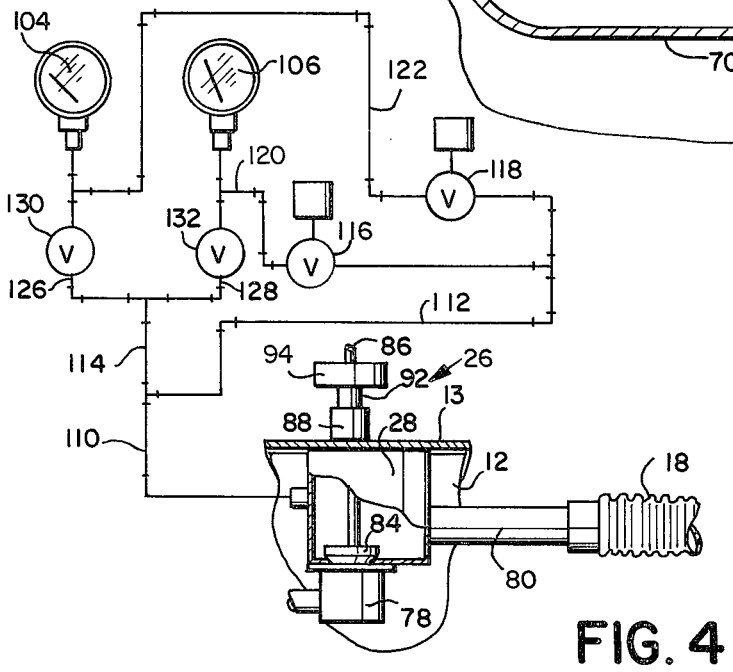
FIG. 4 is a schematic view of the vacuum gauge indicating means illustrated in FIG. 2.

Means for detecting the amount of force with which air is being drawn from the device through air conduit 18 is provided in the form of a vacuum gauge system 100 which includes two gauges 104 and 106. Preferably, the gauges are set to read different scales or quantities such as 30 inches or 60 inches of vacuum so that, depending on the strength of the user's lungs, one, or the other, or both of the gauges can be used. The gauges can be brought into the system either manually or electrically as by solenoids. As best seen in FIG. 4, a conduit 110 which is connected to the aforementioned outlet conduit 18 has two branches 112 and 114. Branch 112 is connected to solenoid controlled valve housings 116 and 118. A conduit 120 is connected between valve housing 116 and 60 inch gauge 106 while conduit 122 is connected between valve housing 118 and 30 inch gauge 104.

Thus energization of the solenoid valves in housings 116 and 118 permits a vacuum to be drawn from their respective gauges through the conduits 120 and 122 and then conduit 112 to the outlet conduit 18. Thus by selectively energizing the solenoid valves 116 and 118, gauges 104 or 106 or both of them can be engaged to measure and give a visual indication of the vacuum being created as air is withdrawn from the device.

Conduit 114 is further divided into conduits 126 and 128. Each of the conduits 126 and 128 include a manual valve 130 and 132 which are connected to the respective gauges 104 and 106.

Thus, if for some reason the solenoid controlled valves 116 and 118 are not used or cannot be used, the manual valves can be employed to bring the gauges into the system so that the user can have a visual indication of the amount of vacuum that is being drawn.

The amount of effort which is required can be varied depending on the number of weights which are attached to valve stem 86.

Figure 6:
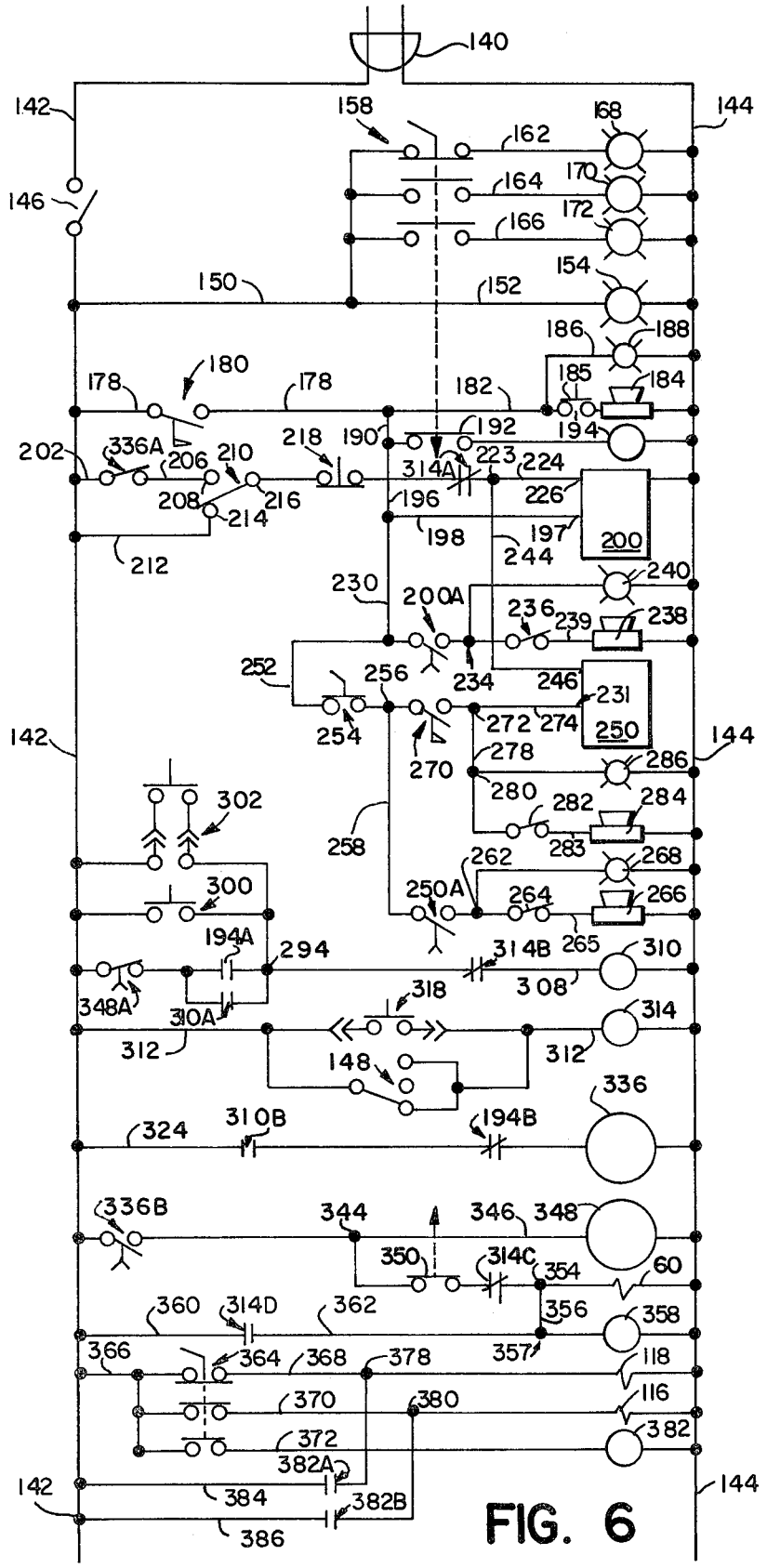
FIG. 6 is a circuit drawing illustrating the timing and feedback devices of the device of FIG. 1.

The device can be arranged to provide a rigorous exercising program by means of the information provided on the control panel 16 and the circuit arrangement illustrated in FIG. 6.

Figure 5:
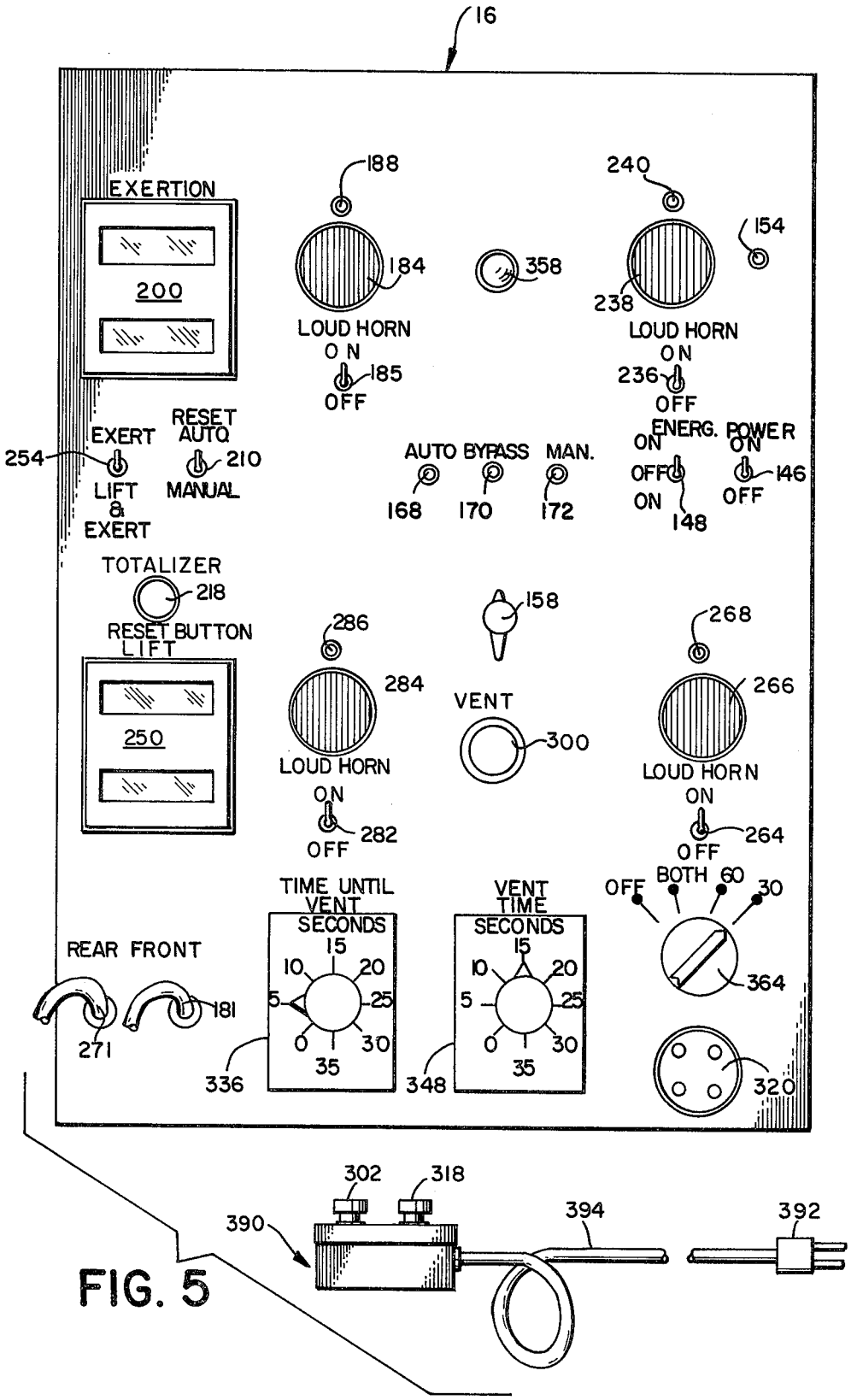
FIG. 5 is a view of the front panel of the control box of the device illustrated in FIG. 1.

Referring to FIG. 5, the control panel 16 comprises a front plate. Mounted on the front plate is On-Off power switch 146 which may be disposed adjacent to emergency vent-reset switch 148 and "On-Off" indicator light 154.

The device can operate in three modes, namely, automatic venting, bypass venting and manual venting. The modes are selected by moving rotary switch 158 to the various positions just named. At each switch position a pilot light 168, 170 or 172 indicates that the device is in the mode selected.

Two manually set timers 336 and 348 are provided for controlling the length of time the device vents and the intervals of time between the cessation of inhalation and the beginning of the venting interval when the device is in its automatic or manual modes. Timer 336 determines when the vent valve solenoid 60 will be energized to vent the device. It is called the "Time Until Vent" timer. Timer 348 indicates the amount of time that vent valve solenoid 60 is energized to permit the device to vent.

By selecting appropriate times on "Vent Time" timer 348 and "Time Until Vent" timer 336, the rate at which the device will move through its cycle can be determined.

Two totalizers are provided. Totalizer 200 measures exertion time, i.e., the time that the user is drawing air through the system while totalizer 250 is used to measure lift time, i.e., the time that valve head 84 is raised from seat 82. The totalizers which are manufactured by Automatic Timing and Controls Corporation are electrically resettable timers. They display both a preset time and elapsed time. While time is elapsing, a first circuit is engaged. When the elapsed time has reached the preset time, a circuit is engaged. In the context of Exertion Totalizer 200, from the moment air is drawn through the device horn 184 and indicator light 188 are energized. Upon achievement of the desired duration of exertion, horn 238 and its respective indicator light 240 may also be energized.

In a like fashion, Lift Totalizer 250 and its respective lights and horns 266, 268, 284 and 286 are energized. Since each horn has a pilot light 268 and 286, if the horns are disabled, achievement of the goals can be detected by the lights.

The Totalizers can be reset by depressing Reset Button 218 when switch 210 is in the manual position. Otherwise the Totalizers are automatically reset as will be explained herein. Switch 254 enables sole operation of the Exertion Totalizer 200, or operation of both Totalizers.

The horns can be selectively removed from the circuit by actuation of manual switches 185, 236, 282 and 264.

A remote unit 390 for venting the device and for resetting the Totalizers is provided. It is plugged into outlet 320 on panel 16 by plug 392.

Suitable means can be provided in the form of a switch 364 for selectively energizing the solenoids 116 and 118 for connecting vacuum gauges 104 and 106 to the system.

The device can be plugged into a standard 120 volt outlet. As best illustrated in FIG. 6, the power cable 140 comprises first and second lines 142 and 144. Line 142 includes the On-Off power switch 146 for the device.

Connected to line 142 are lines 150 and 152. Line 152 includes a "power on" light 154 which is energized when switch 146 is closed.

The vent switch 158 is connected to lines 150 and 152. The vent switch circuit comprises lines 162 which is energized when the vent is in its "automatic mode", line 164 when it is in the "bypass mode", and line 166 when it is in the "manual mode". Each of the lines 162, 164, and 166 has its respective indicator light 168, 170 and 172 to indicate the mode that the device is in.

The circuit which includes the Totalizers 200 and 250 comprises line 178 which is connected by way of front air switch 180, line 182, switch 185 and line 187 to a first horn 184, and by line 186 to an indicator light 188. The front air switch 180 has its sensor connected to the elongated air flow conduit between valve 26 and the mouthpiece 27. Its switch element which is in the control panel 16 is connected to the air flow conduit 14 by conduit 181.

At the juncture of lines 178 and 182, a further line 190 is connected by way of switch 192 to a first relay coil 194. Switch 192 is connected to switch 158 and is closed when switch 158 is in the "manual" and "bypass" modes. Line 190 is connected by way of line 196 and line 198 to the input terminal of Exertion Totalizer 200.

Line 142 is connected by way of line 202 and Timer Contact 336A and line 206 to the "off" contact 208 of the manual reset switch 210. Line 142 is connected by line 212 to the "on" terminal 214 of the manual reset switch 210. The remaining terminal 216 of the manual reset switch 210 is connected by way of reset button 218 and normally closed third relay contact 314A, juncture 223 and line 224 to the "reset" terminal 226 of Exertion Totalizer 200.

Line 196 is connected to the time accumulation terminal 197 on Exertion Totalizer 200. It is also connected by way of line 230 and Totalizer contact 200A to juncture 234. Juncture 234 is connected to manual switch 236, which controls horn 238, through line 239, and to indicator light 240. Totalizer contact 200A is a part of the Exertion Totalizer 200. It closes when the time accumulated on Totalizer 200, at terminal 197, reaches the preset time, thereby energizing the horn 238 and light 240.

Juncture 223 is connected by way of line 244 to the reset terminal 246 of Lift Totalizer 250.

Line 230 is connected to the time accumulation terminal 231 on Lift Totalizer 250. This is through a path that includes line 252, switch 254 and juncture 256. Juncture 256 is connected by way of line 258 and Totalizer contact 250A to juncture 262. Juncture 262 is connected both to the manual On-Off switch 264 and indicator light 268. Switch 264 is connected to horn 266 by line 265. Totalizer contact 250A is a part of the Lift Totalizer 250 and closes when the time accumulated on Totalizer 250 at terminal 231 reaches the preset time to energize the horn 266 and light 268.

Additionally, juncture 256 is connected to rear air switch 270. Juncture 272 is connected by way of line 274 to air switch 270 and the accumulation terminal 231 on Lift Totalizer 250, and by way of line 278 to juncture 280. Juncture 280 is connected to the manual horn control switch 282 and horn indicator light 286. Horn switch 282 is connected to horn 284 by line 283. The rear air switch 270 has its sensor connected to the elongated air flow conduit between valve 26 and the juncture of the bellows 22 and the inlet duct 38. Its switch element which is in the control panel 16 is connected to the air flow conduit by conduit 271.

The portion of the circuit for venting the device and resetting the Totalizers comprises timer contact 348A and normally open first relay contact 194A and juncture 294. Normally open second relay contact 310A is connected between Timer Contact 348A and juncture 294 in parallel with normally open first relay contact 194A. Vent button 300 on panel 16 and remote vent button 302 which is on unit 390 are both connected in parallel between line 142 and juncture 294. Juncture 294 is connected by way of normally closed third relay contact 314B and line 308 to a second relay coil 310, which is in turn connected to line 144.

A combined remote and panel mounted vent and Totalizer reset circuit comprises line 142 which is connected by way of line 312 to a third relay coil 314. Intermediate the ends of line 312 is the vent and Totalizer reset switch 148. This may be a toggle switch which closes when pushed in either direction. Also in parallel is remote vent and Totalizer reset button 318, located on remote unit 390.

The timer circuit includes "Time Until Vent" timer 336 and "Vent Time" timer 348. Line 142 is connected by way of line 324 and another normally open second relay contact 310B and normally closed first relay contact 194B to "Time Until Vent" timer 336. Timer 336 can be preset to select the amount of time between the end of exertion and the beginning of venting time. When the preselected time is reached, timer contact 336A in the Totalizer circuit will open and timer contact 336B in the "Vent Time" timer 348 circuit will close.

Line 142 is connected by way of before mentioned timer contact 336B to juncture 344. Juncture 344 is connected by way of line 346 to "Vent Time" timer 348. Timer 348 can be set to select the amount of time the device will be vented. When the predetermined selected time is reached timer 348 causes timer contact 348A in the venting circuit to open to de-energize second relay 310. Juncture 344 is connected by way of switch contact 350 and normally closed third relay contact 314C to juncture 354. Switch 350 is coupled to switches 158 and 192 and is closed when switch 158 is in the "auto" and "manual" modes. Juncture 354 is connected to the solenoid element 60 in cylindrical housing 42. Juncture 354 is also connected by way of lines 356 and juncture 357 to venting indicator light 358. Line 360 is connected between line 142 and aforementioned juncture 357 through normally open third relay contacts 314D.

The vacuum gauge solenoid circuit comprises a four position selector switch 364 on panel 16. The connections to switch 364 are at the juncture of lines 142 and 366. Line 366 has three branches, namely, 368 which corresponds to energization of the 30 inch vacuum gauge, 370 which corresponds to energization of the 60 inch vacuum gauge, and 372 which corresponds to energization of both vacuum gauges. Line 366 is connected through switch 364 and juncture 378 to solenoid 118. Line 366 is connected through switch 364 and juncture 380 to solenoid 116. Line 366 is connected through switch 364 to fourth relay coil 382. Normally open fourth relay contact 382A extend between line 162 and junction 378, while normally open fourth relay contact 382B extend between line 142 and juncture 380. All neutral sides of relays, timers, indicator lights, valves and horns are connected to line 144.

The relay coils control the various relay contacts. Thus when first relay coil 194 is de-energized, contact 194A is open and contact 194B is closed. When first relay coil 194 is energized, normally open contact 194A is closed and normally closed contact 194B is opened. When second relay coil 310 is energized, normally open contacts 310A and 310B are closed. When third relay coil 314 is energized, normally closed contacts 314A, 314B and 314C open while contact 314D closes. When fourth relay coil 382 is energized, normally open contacts 382A and 382B close.

When the device is used, the user or the therapist will select the mode of operation. If the bellows 22 are not to be used, then the device will be operated in the "by-pass" mode. However, in both the "automatic" and "manual" modes the bellows are used.

The operation of the device will not be described for the "automatic" mode.

(A) Automatic Mode

The setting of vent switch 158 to "automatic" completes the circuit to indicator light 168 and closes switch 192 to enable first control relay 194. It also closes switch 350 leading to vent solenoid 60. Vent valve 24 remains closed since timer contact 336B is open.

When the user places mouthpiece 27 in his mouth and starts to inhale, a vacuum is developed on conduit tubing 14 which is detected by front air switch 180. This completes a circuit through lines 190 and switch 192 to energize first relay 194. At the same time it energizes light 188 and depending on the position of switch 185 energizes horn 184 to provide a first signal to the user that inhalation is taking place. This signal remains "on" while the user is inhaling. The closure of the front air switch 180 also sets or activates Exertion Totalizer 200 through line 198. The Totalizer is provided with a digital readout so that the user is always cognizant of his total inhalation time. The closure of switch 180 also closes the circuit to two position switch 254.

The switch 254 is movable between first and second positions. In its first position it is open and electrically isolates the Lift Totalizer from the rest of the circuit. In its second position, switch 254 enables the circuit to the Lift Totalizer through rear air switch 270. Where only total inhalation time is desired, the switch 254 is set to disable the Lift Totalizer and the Exertion Totalizer 200 is used exclusively.

Lift Totalizer 250 starts operating only when valve head 84 has raised to cause closure of rear air switch 270.

Activation of Lift Totalizer 250 is indicated both by light 286 and, if toggle switch 282 is set "on" by horn 284. Horn 284 is normally tuned to provide a signal having a tonal quality readily distinguishable from that of output 184. In use, both Totalizers are preset to establish particular exertion and lifting goals. When the inhalation or "exertion" time set on Exertion Totalizer 200 is reached, Totalizer contact 200A closes to energize indicator light 240. If toggle switch 236 is closed, it will energize third audible signal 238 also to tell the user that his exertion goal has been reached.

Similarly, if the preset goal for lifting valve head 84 is reached, Lift Totalizer contact 250A closes to energize indicator light 268 and, through toggle switch 264, energize audible signal 266. Thus it is possible to have 4 separate indicator lights and audible signals operating all at once during the inhalation cycle. In the present device, the four audible signals are tuned to provide a distinctive musical chord.

The two Totalizers cooperate to provide different measures of lung capabilities. Exertion time is a measure of the total time the user is inhaling. It is also a measure of the ability of the user to draw air into his lungs.

Lifting time is a segment of exertion time. It measures the length of time the lungs are able to create a vacuum sufficient to open valve 26.

Since lifting of the valve head 84 cannot occur until exertion takes place, the faster lifting takes place after exertion begins; the stronger the users' lungs are.

The ability to change the loading on valve stem 86 allows the user first to establish a base value of lung strength and then to set up a program to build it in a steady, controlled manner. The total time of exertion or inhalation is a measure of lung capacity and is responsive to both increased chest expansive capacity and improvements in the general air absorptive capability normally accompanying any exercise routine.

Returning to FIG. 6, it is seen that control relay 194 is one of a set of four such relays in the circuitry of device 10, said relays being identified as 194, 310, 314 and 382 respectively. The energization of relay 194 by the closure of front air switch 180 also closes normally open contact 194A to energize the second control relay 310 through the closed contact 348A of "vent" timer 348 and normally closed contact 314B. Also normally closed relay contact 194B to "Time to Vent" timer 336 is opened which de-energizes that timer while inhalation is occurring. When second control relay 310 is energized, it closes relay contact 310A so that second control relay 310 will be locked "on" as long as timer contact 348A is closed and third control relay 314 has not been energized. It also closes relay contact 310B to enable timer 336.

When inhalation stops, front air switch 180 opens and de-energizes control relay 194. This causes relay contact 194A to open and relay contact 194B to close. The opening of relay contact 194A does not open a circuit since second relay contact 310A is still closed. However, closing normally closed relay contact 194B completes the circuit to energize "Time Until Vent" timer 336. As noted above, this provides a controlled time interval between the cessation of inhalation and the start of venting. This "Time Until Venting" period provides the therapist or operator time to record the Totalizer figures before the unit automatically resets. At the conclusion of this interval, time contact 336A opens and contact 336B closes. If manual reset switch 210 is "off" both of the Totalizers will be reset. Otherwise, reset button 218 must be depressed. Closing of timer contact 336B energizes Vent Timer 348 and vent solenoid 60 through normally closed third contact 314C. With the opening of vent solenoid valve 64, the air pressure in the device returns to normal. If bellows 32 are connected to the device, they will collapse and the device is ready for the next breathing cycle. The venting condition is shown by indicator light 358.

During vent time, timer contact 348A remains closed to lock in second control relay 310. At the end of the predetermined venting interval, contact 348A opens to de-energize second control relay 310. This reopens second relay contact 310B to disable "Time Until Vent" timer 336. This, in turn, reopens timer contacts 336B to deactivate "Vent Time" timer 348. At the same time, timer contact 336A which has opened to reset the Totalizers 200 and 250 closes to ready Totalizers for next breathing cycle.

(B) Manual Mode

In addition to the fully programmed automatic mode of operation described above, device 10 allows the user to set his own breathing program in which the start of venting can be varied during the exercise routine as air intake needs change. This is done by setting vent swtich 158 to the "manual" position. In this position, switch 192 remains open so that control relays 194 and 310 are not energized. Switch 350 is closed to enable venting solenoid 60. Resetting of the Totalizers will be accomplished any time the manual vent button 300 is pushed.

At the conclusion of the inhalation cycle, the user pushes vent button 300 which energizes second control relay 310 to close relay contacts 310A and 310B to lock control relay 310 in its energized state and to energize and start "Time Until Vent" timer 336 and the remainder of the vent cycle as described above.

(C) Bypass Mode

In still a third mode of operation, namely, the Bypass Mode, the user can completely bypass the venting subsystem while still monitoring inhalation times as described above. In this mode the bellows volumetric monitoring is suspended. The Bypass Mode is useful if the user is only interested in increasing lung strength.

To go into the Bypass Mode the bellows is disconnected from the device and vent switch 158 is displaced to the "bypass" position. In this configuration pilot light 172 is energized, switch 192 is open to isolate relay 194 and disable its contacts 194A and 194B; and switch 350 is open to disable the solenoid 60.

In this configuration inhalation closes front air switch 180 to initiate the accumulation of time on Exertion Totalizer 200 and to energize the horn and light 184 and 188. At the same time, assuming that switch 254 is closed, once the valve head 84 is lifted off its seat, rear air switch 270 closes to begin the accumulation of time on Lift Totalizer 250 and to energize the audible and visual alarms 284 and 286.

It is not necessary to be concerned with "Time Until Vent" timer 336 or "Vent Time" timer 348 since they are never energized. Venting is no concern in this mode since the pressure on both sides of valve head 84 is the same.

(D) Remote Venting

In the manual mode of operation, device 10 can be arranged for remote venting operation so that the device can be used while the user is on a treadmill, stationary bicycle or similar piece of exercise equipment. To this extent, the remote unit 390 is provided. This is connected to control panel 16 by coiled wire 394 and plug 392. When the unit 390 is plugged into the outlet 320 on panel 16, the circuit to second control relay 310 is completed through remote vent switch 302. When remote button 302 is pressed, venting takes place in exactly the same manner as when vent button 300 is depressed.

(E) Remote and Local Reset

At any time and in any mode of the device, it may be necessary to reset the entire system. This can be done either from a remote location or on the device itself. To this extent the remote unit 390 includes a remote reset button 318. When the plug 392 is connected to panel 16, switch button 318 is connected to the circuit in parallel with panel reset button 148. Closing of either button energizes third control relay 314. This opens normally closed relay contacts 314A and 314B to reset Totalizers 200 and 250 and to de-energize relay 310. Secondly, normally closed contact 314C opens and normally open contact 314D closes to energize the Vent Solenoid 60 to vent the system and disable venting timer 348. Such an action is used to finish a breathing cycle by collapsing the bellows without waiting for timers 336 and 345 to complete their cycle.

(F) Vacuum Gauging

As noted above the use of vacuum gauges 104 and 106 is optional. None, either or both gauges can be selected by selector switch 364. As shown in FIG. 5, switch 364 can activate either, both or none of these gauges. When switch 364 is positioned to actuate the 30 inch vacuum gauge 104, a circuit is completed from line 142 to solenoid 118. When switch 364 is positioned to actuate the 60 inch vacuum gauge 106, a circuit is completed from line 142 to solenoid 116.

The switch 364 also has an "off" position where no gauges will be activated.

When switch 364 is positioned to actuate both of the vacuum gauges, a circuit is completed from line 142 through line 372 to energize fourth relay 382. This closes normally open relay contacts 382A and 382B to complete circuits through lines 384 and 386 to junctures 378 and 380 to energize the solenoids 118 and 116 to actuate the vacuum gauges.

From the foregoing, it should be apparent that the device described herein provides a programmable lung exercising machine which allows the user to set particular inhalation goals and receive feedback as to his success in meeting them.

Lastly, the device provides for controlled in-leakage at valve 86 and emergency refill capabilities in the event that the user is unable to activate the automatic timing and refill cycles during use and thus prevent asphyxiation problems.

The present invention may be embodied in other specific forms without departing from the spirit and essential attributes thereof.

I claim:

1. A device for increasing the strength and inhalation capacity of the users' lungs including:

an air inlet and an air outlet, a conduit connecting said inlet and said outlet, said outlet including a mouthpiece, a first valve in said conduit, said first valve being operable by the pressure differential created when the user inhales through said mouthpiece, means for biasing said first valve to normally closed position, said means being adjustable so that the force required to open said first valve during inhalation can be varied to increase the strength of the users' lungs.

2. A device as defined in claim 1 including means for measuring the volume of air drawn into said air inlet during inhalation.

3. A device as defined in claim 1 including means for measuring the vacuum drawn by the user during inhalation.

4. A device as defined in claim 3 wherein said vacuum measuring means is disposed between said first valve and said air outlet.

5. A device as defined in claim 1 including means for measuring the time interval during which said first valve is open.

6. A device as defined in claim 5 wherein said measuring means includes pressure differential detecting means disposed between said inlet and said first valve, a timer and a switch means, said switch means being operable to complete a circuit to said timer when the presence of a pressure differential is detected.

7. A device as defined in claim 5 including means for selecting a predetermined interval during which said first valve is to be maintained open, an energizable signal, and means for energizing said signal when said first valve has been opened for said predetermined interval.

8. A device as defined in claim 1 including bellows, said bellows having an outlet, said bellows outlet being connected to said air inlet, a venting valve in said conduit between said bellows and said first valve, said venting valve being normally closed, and energizable means for selectively opening said venting valve to permit air to enter said conduit and vent said device.

9. A device as defined in claim 8, including a presettable timer which can be set to a predetermined interval, said energizable means being electrically coupled to said timer so that after said predetermined interval said energizable means is energized to vent said device.

10. A device as defined in claim 8 including means for selecting the time interval during which said venting valve is open to vent said device.

11. A device as defined in claim 10 wherein said means interval for selecting the time includes a timer.

12. A device as defined in claim 8 including means for selecting the time interval between the cessation of inhalation and the opening of said venting valve.

13. A device as defined in claim 12 wherein said means for selecting said time interval includes a timer.

14. A device as defined in claim 8 including:

a first timer coupled to said venting valve for opening said venting valve for a first predetermined time interval; a second timer, said second timer being operative to select a second predetermined time interval between the cessation of inhalation and the opening of said venting valve; and means for coupling said first and second timers to each other so that said first timer is energized and said venting valve is opened when said second timer reaches the end of said second predetermined time interval.

15. A device as defined in claim 14 including means for overriding said second timer to open said venting valve.

16. A device as defined in claim 15 wherein said overriding means includes a switch means and a plurality of contacts, said switch means being operative to selectively open and close selective ones of said contacts to disable said timers and open said venting valve.

17. A device as defined in claim 1 including means for detecting and measuring the time that said air is being drawn through said outlet.

18. A device as defined in claim 17 wherein said means for detecting includes pressure differential detecting means disposed between said first valve and said mouthpiece, a switch means and a timer, said switch means being operable to complete a circuit to said timer when the presence of a pressure differential is detected.

19. A device as defined in claim 18 including means for selecting a predetermined interval during which said pressure differential is to be detected, an energizable signal, and means for energizing said signal when said pressure differential is detected for the same time as said predetermined interval.

20. A device as defined in claim 7 or 19 wherein said signal comprises first and second signals, said first signal being energized as soon as said pressure differential is detected, and said second signal being energized at the end of said predetermined interval.

21. A method for increasing the strength and inhalation capacity of the lungs comprising the steps of inhaling through a mouthpiece and conduit to create a vacuum in said conduit of sufficient force to open a variable resistance valve in said conduit, and inhaling atmospheric air through said mouthpiece and said conduit upon the opening of said variable resistance valve.

22. A Method as defined in claim 21 including the step of measuring the volumne of air inhaled.

23. A Method as defined in claim 21 including the step of varying the resistance of said valve and repeating said steps.

24. A Method as defined in claim 21 including the step of measuring the time interval during which said valve is open.

25. A Method as defined in claim 21 including the steps of providing a predetermined volume of air for inhalation, and venting said device at a predetermined time after inhalation.

* * * * *